United States Patent [19]

Ohta et al.

[11] Patent Number: 4,712,111

[45] Date of Patent: Dec. 8, 1987

[54] ANTENNA SYSTEM

[75] Inventors: Tomozo Ohta, Ikoma; Kazutada Higashi; Hirohiko Yamamoto, both of Tenri, all of Japan

[73] Assignee: Sharp Kabushiki Kaisha, Osaka, Japan

[21] Appl. No.: 813,535

[22] Filed: Dec. 26, 1985

[30] Foreign Application Priority Data

Dec. 26, 1984 [JP] Japan ..... 59-277657
Mar. 15, 1985 [JP] Japan ..... 60-52804

[51] Int. Cl.[4] ..... H01Q 19/17

[52] U.S. Cl. ..... 343/779; 343/840; 343/914

[58] Field of Search ..... 343/908, 909, 912, 914, 343/781 R, 779, 781 P, 756

[56] References Cited

U.S. PATENT DOCUMENTS 2,600,274 6/1952 Sichak ..... 343/914 X
2,975,419 3/1961 Brown ..... 343/912 X
3,430,246 2/1969 Le Parquier et al. ..... 343/914 X
3,680,141 7/1972 Karikomi ..... 343/914 X
4,109,253 8/1978 Chu ..... 343/909 X
4,482,897 11/1984 Dragone et al. ..... 343/779
4,491,848 1/1985 Dragone ..... 343/781 P
4,544,928 10/1985 Afifi et al. ..... 343/914 X
4,618,866 10/1986 Makino et al. ..... 343/779

FOREIGN PATENT DOCUMENTS 0916274 1/1963 United Kingdom ..... 343/779

*Primary Examiner*—Daniel M. Yasich
*Attorney, Agent, or Firm*—Birch, Stewart, Kolasch & Birch

[57] ABSTRACT

An antenna system includes a reflector which is a part of a paraboloid of revolution or parabolic cylinder, a primary radiator for clockwise circularly polarized wave, and a primary radiator for counterclockwise circularly polarized wave. The reflector is of geometrically asymmetrical shape to effect different reflection properties for clockwise and counterclockwise circular polarizations. The primary radiators are fixed at two different positions in the vicinity of the focus of the paraboloid reflector.

13 Claims, 7 Drawing Figures

FIG. 5
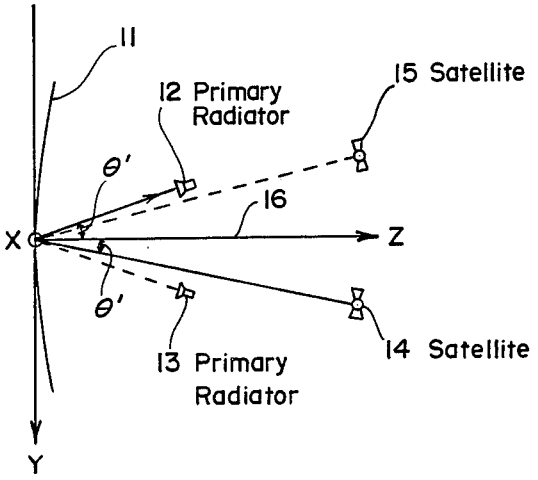
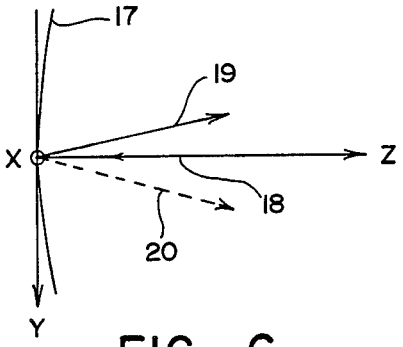
FIG. 6
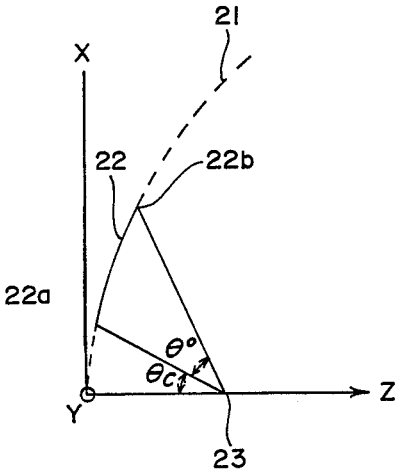
FIG. 7

ANTENNA SYSTEM

BACKGROUND OF THE INVENTION

The present invention relates to an antenna system for receiving and transmitting clockwise and counterclockwise circularly polarized wave signals.

Recently, many countries have been participating in satellite communication. Various kinds of antenna for receiving broadcast waves from satellites have been developed.

Satellite communication on 12 GHz band uses circularly polarized waves to avoid crosstalk between channels and between broadcast waves of various countries. Each of these countries are allocated a particular frequency band and either clockwise or counterclockwise circularly polarized waves. In addition, the positions of satellites in stationary orbits are also fixed for each country. In some cases, two or more satellites are positioned in one place to transmit clockwise and counterclockwise circularly polarized waves respectively.

In such a situation, if one satellite communication-receiving antenna system can receive clockwise and counterclockwise circular polarized waves simultaneously or at different times, it would be extremely useful because it can receive more broadcast waves than previously known satellite communication-receiving antenna systems.

In general, a satellite communication-receiving antenna system is composed of a reflector and a primary radiator fixed on the focus of the reflector. The primary radiator is usually designed and used for receiving either clockwise or counterclockwise circularly polarized waves.

To receive clockwise and counterclockwise circularly polarized waves sent from different broadcasting satellites by the conventional antenna system, therefore, the system must be equipped with a plurality of reflectors and primary radiators. As a result, the system construction cost and labor increase accordingly.

Therefore, an antenna system of simple construction capable of receiving both clockwise and counterclockwise circularly polarized waves, if realized, is quite useful for satellite communication.

SUMMARY OF THE INVENTION

It is an object of the present invention to provide an antenna system that can receive or transmit clockwise and counterclockwise circularly polarized waves from broadcasting satellites in stationary orbits.

It is very convenient if one antenna system can receive or transmit clockwise and counterclockwise circularly polarized waves from different satellites positioned in the same or different stationary orbits. Another object of this invention is to provide an antenna system having the above capability.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

To achieve the above objects, the antenna system of an embodiment of the invention comprises a geometrically asymmetrical reflector such as an offset segment of a paraboloid reflector located above a central longitudinal or z axis and primary radiators offset from the central longitudinal axis along the horizontal or y axis, the x axis being the vertical axis, for clockwise and counterclockwise circularly polarized waves respectively, the primary radiators being fixed in different positions with respect to the reflector. That is, paying attention to the fact that the asymmetry of the reflector causes the beams of the clockwise and counterclockwise circularly polarized waves to be reflected in different directions, the primary radiators for clockwise and counterclockwise circularly polarized waves are fixed in different positions, so that clockwise and counterclockwise circularly polarized waves from the exterior are reflected by the reflector and received by the respective primary radiators.

Each of the primary radiators used in the invention may be of any desired type if it is designed either for clockwise or counterclockwse circularly polarized wave. To make the antenna system structure simple, a simple antenna such as a helical or patch antenna maybe used.

The present invention is not restricted to a receiving antenna but is also applicable to a transmitting antenna system based on the same principle.

To achieve the above object, the antenna system of another embodiment of the invention comprises a geometrically asymmetrical reflector such as a vertically offset paraboloid reflector segment and primary radiators for clockwise and counterclockwise circularly polarized waves respectively, the primary radiators being fixed in different offset positions with respect to the central longitudinal axis of the reflector, so that clockwise and counterclockwise circularly polarized waves coming from the same or different directions are taken out simultaneously or at different times by the respective primary radiators. That is, paying attention to the fact that the asymmetry or vertical offset of the reflector causes the beams of the clockwise and counterclockwise circularly polarized waves to be reflected in different directions, the primary radiators for clockwise and counterclockwise circularly polarized waves are fixed in different positions, so that clockwise and counterclockwise circularly polarized waves coming from the exterior with the same or different incident angles are reflected by the reflector and taken out separately in accordance with the respective primary radiators.

According to the present invention based on the above principle, an antenna system comprises an offset reflector which is a part or segment of a paraboloid of revolution or parabolic cylinder, a clockwise circular polarization primary radiator and a counterclockwise circular polarization primary radiator, the reflector being of a shape to provide different reflection characteristics for clockwise and counterclockwise circularly polarized waves respectively, the clockwise and counterclockwise circular polarization primary radiators being fixed at two different positions near the focus of the paraboloid of the reflector and offset from the central longitudinal axis, whereby clockwise and counterclockwise circularly polarized waves from the respective primary radiators are reflected by the reflector and transmitted in different directions.

BRIEF DESCRIPTION OF THE DRAWINGS

The present invention will be better understood from the detailed description given herein below and the accompanying drawings which are given by way of illustration only, and thus are not limitative of the present invention in which:

FIG. 5 is a plan view illustrating the antenna of still another embodiment of the invention;

FIG. 6 illustrates the reflected beam characteristic of a circularly polarized wave in a typical offset parabolic antenna viewed from above; and FIG. 7 is a side view of the reflector illustrating the reflection characteristic of the antenna system of the invention.

DETAILED DESCRIPTION OF THE INVENTION

The invention will be described using an antenna system that contains an asymmetrical offset parabolic antenna formed by a part of the paraboloid of revolution, a typical embodiment of the invention. All of the figures are to be considered as representations in an environment defined by three orthogonal axes, x, y, and z.

Figure 3:
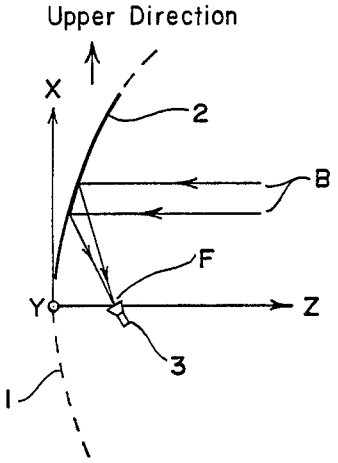
FIG. 3 shows a typical offset parabolic antenna.

FIG. 3 shows an ordinary offset parabolic antenna. 1 is a paraboloid of revolution, 2 is a reflector formed by a part i.e., a segment of the paraboloid of revolution 1, 3 is a primary radiator, B is an incident wave beam, and F is the focus of the paraboloid of revolution 1. The primary radiator 3 is fixed at the position of the focus F.

As shown in the figure, the offset paraboloid antenna uses the asymmetrical reflector 2. As a result, the primary radiator 3 is positioned outside the aperture of the reflector, avoiding aperture blocking. With this antenna system linearly polarized excitation results in a cross polarized component due to the asymmetrical reflected surface. On the other hand, circularly polarized excitation does not result in cross polarized component because the circularly polarized wave becomes positively polarized component through 90° phase shift. The direction of principle reflection beam is different between clockwise and counterclockwise circularly polarized waves.

Figure 4:
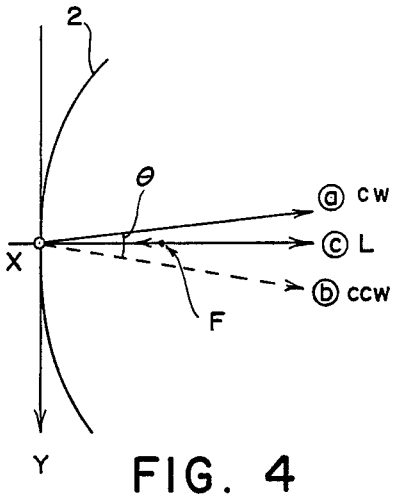
FIG. 4 illustrates the reflection characteristic of a circularly polarized wave in an offset parabolic antenna.

FIG. 4 shows the directions of principal reflected beams, assuming that a polarized wave is fed from the position of the focus F. FIG. 4 is a top view of the offset parabolic antenna shown in FIG. 2. Clockwise circularly polarized wave radiation from the position of the focus F is reflected by the reflector 2 so that the principal beam is directed as shown by the solid line ⓐ. Counterclockwise circularly polarized wave radiation from the focus F is reflected by the reflector so that the principal beam is directed as shown by the broken line ⓑ. For linearly polarized wave radiation, the principal beam is directed as shown by the chain line ⓒ which is parallel to z axis of the offset parabolic antenna.

Figure 1:
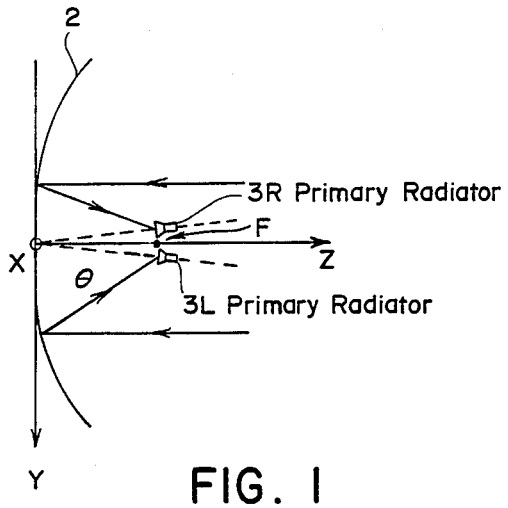
FIG. 1 illustrates the an offset parabolic antenna of an embodiment of the present invention viewed from the top.

The present invention is based on the above mentioned difference in the reflection characteristic between clockwise and counterclockwise circularly polarized waves. FIG. 1 shows an embodiment of the offset parabolic antenna of the present invention, viewed from above.

Figure 2:
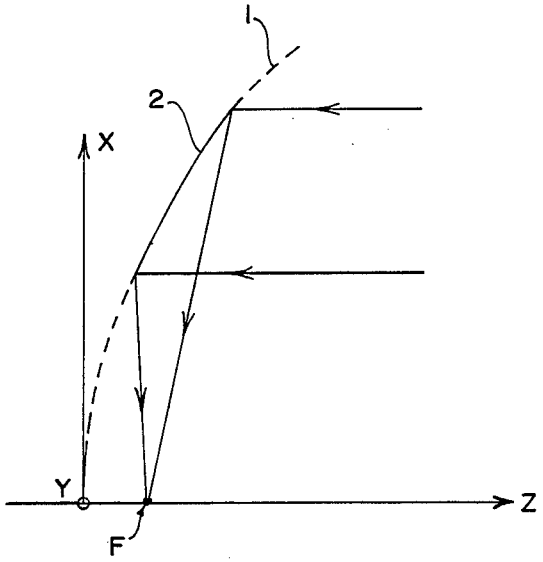
FIG. 2 illustrates radiation characteristic of another embodiment of the invention.

In FIG. 1, 2 is the same reflector as shown in FIG. 3, F is the focus of the paraboloid of revolution (referred to as 1 in FIG. 2), 3R is a clockwise circular polarization primary radiator, and 3L is a counterclockwise circular polarization primary radiator. The clockwise circular polarization primary radiator 3R is fixed at a position to the right of the focus F (above the focus F in FIG. 1) on the plane defined by z axis and y axis. The counterclockwise circular polarization primary radiator 3L is fixed at a position to the left of the focus F (above the focus F in FIG. 1) on the plane defined by z axis and y axis. The primary radiators 3R, 3L are offset from the axis of symmetry ,i.e. the central longitudinal or z axis by the angle $\theta$ to compensate for the beam displacement by reflection of circular polarization waves by the reflector. This angle $\theta$ is equivalent to the angle $\theta$ between the solid line ⓐ or broken line ⓑ and the z axis shown in FIG. 3.

In the antenna system with the above construction, clockwise and counterclockwise circularly polarized waves coming from the same direction (that is, from the direction along z axis) are reflected by the reflector 2 into different directions. Then, the principal reflection beams of the circularly polarized waves are simultaneously or individually received by the primary radiators 3R, 3L respectively.

When the antenna system is being used for transmission, clockwise and counterclockwise circularly polarized radiations from the respective primary radiators 3R, 3L are reflected by the reflector, so that the principal beams of the circularly polarized radiations are sent off in the same direction (that is, in the direction along z axis).

The primary radiators 3R, 3L may be of any type as long as they are especially designed for clockwise and counterclockwise circular polarizations respectively. A compact antenna system can be achieved by employing small elements such as helical elements or micro strip elements for the primary radiators 3R, 3L.

As shown in FIG. 2, a part of the paraboloid of revolution 1 which constitutes the reflector 2 may be away from the axis of symmetry i.e. z axis, and the focus F may be closer to the symmetrical center of the paraboloid of revolution 1 to increase the asymmetry of the reflector 2. In this case, the angle $\theta$ is made larger than that shown in FIG. 1, which is convenient in installing the primary radiators 3R, 3L (See FIG. 1).

In the above embodiments, a partial paraboloid of revolution is used for the reflector. A partial parabolic cylinder used as the reflector also provides the same effect as the partial paraboloid of revolution.

According to the present invention, as described above, paying attention to the fact that the beams for the clockwise and counterclockwise circularly polarized radiations shift in opposite directions, the primary radiators for clockwise and counterclockwise circularly polarized waves are arranged in different positions with respect to the geometrically asymmetrical reflector such as an offset parabolic antenna, so that clockwise and counterclockwise circularly polarized waves coming from the same direction (from the broadcasting satellites in the same stationary orbit) are separately received or transmitted by the respective primary radiators.

Since signals with different circular polarization properties sent by one or more broadcasting satellites are received simultaneously by one reflector, the present invention is extremely useful when applied to satellite communication receiving antennas.

Another embodiment of the present invention is now described with reference to FIGS. 5 through 7.

FIG. 5 is a plan view of the antenna system of another embodiment of the present invention, FIG. 6 shows the beam reflection characteristics of circularly polarized waves in a typical offset parabolic antenna viewed from above, and FIG. 7 is a side view of the reflector of this embodiment for describing beam reflection characteristics.

In this embodiment as well, a part of a paraboloid of revolution is used for an asymmetrical vertically offset parabolic antenna reflector which is located above the z axis while being symmetrical along the y axis (FIG. 5).

In FIG. 5, 11 is a reflector, 12 is a clockwise circular polarization primary radiator, 13 is a counterclockwise circular polarization primary radiator, 14 is a satellite transmitting clockwise circularly polarized wave, 15 is a satellite transmitting counterclockwise circularly polarized wave, and 16 is the focus of the reflector 11. The reflector 11 is of the shape of a partial paraboloid of revolution. Which part of the paraboloid of revolution should be used is described below with reference to FIGS. 6 and 7. Suppose a primary radiator is located at the focus 18 of the offset parabolic antenna reflector 17 as shown in FIG. 6. The principal beams of clockwise circularly polarized wave 19 and counterclockwise circularly polarized wave 20 shift in different directions because of the asymmetry of the reflector 17. The amount of each beam shift varies depending on which part of the paraboloid of revolution is selected for the reflector 17.

When a reflector 22 is such part of a paraboloid of revolution 21 as shown in FIG. 7, for instance, the amount of beam shift increases with the angle $\theta c$ between z axis and the line connecting the focus 23 with the end 22*a* of the reflector 22 as well as with the angle $\theta o$ between the above line and the line connecting the focus 23 with the end 22*b* of the reflector 22. Accordingly, the reflector 11 (FIG. 5) of the present invention is formed by the part of the paraboloid of revolution is positioned above the z axis so that the angles $\theta c$ and $\theta o$ are relatively large. As shown in FIG. 5, the clockwise circular polarization primary radiator 12 is positioned to the right of the focus 16 and the counterclockwise circular polarization primary radiator 13 to the left of the focus 16 as viewed from above. The offset angle $\theta'$ of each of the primary radiators 12, 13 from z axis is determined so that the angle $\theta'+\theta_1'$ in FIG. 5 is equivalent to the beam shift. With such arrangement of the primary radiators 12, 13, the principal beams of clockwise and counterclockwise circularly polarized waves from the respective primary radiators 12, 13 are directed to a clockwise circular polarization satellite 14 and counterclockwise circular polarization satellite 15, respectively. Because of the theory of reversibility for antennas, the primary radiators 12, 13 can receive circularly polarized waves from broadcasting satellites with small gain loss.

According to the present invention, as understood from the above description, two primary radiators having clockwise and counterclockwise circular polarization properties respectively are arranged in different positions with respect to a geometrically asymmetric reflector such as an offset parabolic antenna, so that clockwise and counterclockwise circularly polarized wave signals sent from satellites in one or more stationary orbits are separately received by the respective primary radiators or transmitted therefrom. Accordingly, signals with different circular polarization characteristics sent from a plurality of broadcasting satellites can be received by one reflector, which is extremely convenient for a satellite communication-receiving antenna system.

While only certain embodiments of the present invention have been described, it will be apparent to those skilled in the art that various changes and modifications may be made therein without departing from the spirit and scope of the present invention as claimed.

What is claimed is:

1. An antenna system comprising:

a segmented parabolic reflector offset from an axis of symmetry comprising one of the three mutually perpendicular axes;

a primary radiator for a clockwise circularly polarized wave;

a primary radiator for a counterclockwise circularly polarized wave, said reflector reflecting clockwise and counterclockwise circular polarizations in reflection paths having different directions, said primary radiators for clockwise and counterclockwise circularly polarized waves being fixed at two different positions relative to said parabolic reflector, and said reflector reflecting clockwise and counterclockwise circularly polarized waves radiated from said respective primary radiators in respectively different directions.

2. The antenna system as claimed in claim 1 wherein clockwise and counterclockwise circularly polarized wave signals coming from different directions are received by said reflector and reflected to said primary radiators for clockwise and counterclockwise circularly polarized waves, respectively.

3. An antenna system, comprising:

a segmented reflector offset from one axis of three mutually orthogonal antenna axes, said reflector further comprising a segment of a paraboloid;

a primary radiator for clockwise circularly polarized waves;

a primary radiator for counterclockwise circularly polarized waves;

said reflector angularly reflecting said clockwise and counterclockwise circularly polarized waves in mutually opposite directions relative to the direction of reflection of linearly polarized waves, said primary radiators being respectively offset from said one axis along another of said three axes and located at a distance from said reflector substantially equal to the location of a focal point of said reflector which lies on said one axis so as to be located in the reflection paths of the respective circularly polarized waves.

4. The antenna system as defined by claim 3 wherein said one axis comprises a central longitudinal axis extending in a direction outward from the reflecting surface of said reflector.

5. The antenna system as defined by claim 3 wherein said one axis comprises the z axis of three mutually orthogonal x, y and z axes, and wherein the x axis comprises an arbitrarily defined vertical axis, the y axis comprises an arbitrarily defined horizontal axis, and the z axis comprises the central longitudinal axis.

6. The antenna system as defined by claim 5 wherein said primary radiators are horizontally offset from said z axis by a predetermined offset angle and wherein said reflector is vertically offset from the z axis by an elevating angle such that the angle of reflection of said circularly polarized waves from said reflector is greater than said offset angle of said primary radiators, whereby wave energy coupling between at least one of said primary radiators on one side of said z axis is provided with respective external apparatus on the other side of said z axis.

7. The antenna system as defined by claim 5 wherein primary radiators are located on opposite sides of said z axis and on a plane common to the y and z axes.

8. The antenna system as defined by claim 7 wherein said reflector is located above the z axis and being symmetrical about the x axis along the y axis.

9. The antenna system as defined by claim 7 wherein said primary radiators are offset from said z axis and wherein a respective line from the said radiators to said reflector and said z axis define an angle $\theta$ which is substantially equal to the respective angle of reflection of said circularly polarized waves incident upon and reflected from said reflector.

10. The antenna system as defined by claim 3 wherein the angle of reflection of said circularly polarized waves increases as a function of the offset distance of said reflector from said one axis and wherein said offset distance is selected to be such that said angle of reflection is greater than the angle defined by a line from one of said primary radiators to said reflector and said one axis, whereby wave energy translation between said one primary radiator on one side of said one axis is provided with external apparatus on the other side of said one axis.

11. The antenna system as defined by claim 10 wherein said external apparatus comprises a communications satellite.

12. The antenna system as defined by claim 3 wherein said reflector comprises a segment of a paraboloid of revolution.

13. The antenna system as defined by claim 3 wherein said reflector comprises a segment of a parabolic cylinder.

* * * * *